US005997491A

United States Patent [19]

Harris

[11] Patent Number: 5,997,491

[45] Date of Patent: Dec. 7, 1999

[54] HEEL SUPPORT APPARATUS

[76] Inventor: Arthur L. Harris, 813-32nd Ave., Seattle, Wash. 98122

[21] Appl. No.: 08/965,701

[22] Filed: Nov. 7, 1997

[51] Int. Cl.[6] ..... A61F 5/00; A61F 5/37; A47C 20/02

[52] U.S. Cl. ..... 602/6; 602/23; 128/882; 5/648

[58] Field of Search ..... 602/23, 27, 61, 602/65; 178/848, 882; 5/648, 651

[56] References Cited

U.S. PATENT DOCUMENTS

| | | | |
|---|---|---|---|
| 2,911,657 | 11/1959 | Streeter, III | 5/651 |
| 3,162,486 | 12/1964 | Emery | 297/423.41 |
| 4,369,588 | 1/1983 | Berguer | 602/27 X |
| 5,046,487 | 9/1991 | Scott | 602/27 |
| 5,453,082 | 9/1995 | Lamont | 602/27 |
| 5,716,334 | 2/1998 | Wade | 602/6 |

*Primary Examiner*—Richard J. Apley
*Assistant Examiner*—Denise Pothier
*Attorney, Agent, or Firm*—Christensen O'Connor Johnson and Kindness PLLC

[57] ABSTRACT

A heel support apparatus (10) has a substantially flat base portion (12) for resting on a bed surface. An inclined top region (14) of the support apparatus (10) slopes in the upward direction toward the distal region (15) of the support apparatus. The heel support apparatus (10) further includes a central downwardly extending well area (16) for receiving the heel of a patient's foot. A downwardly concaving trough (18) extends from the proximal portion (20) of the support apparatus (10) to intersect the well (16) for receiving the back of the patient's lower leg up to the Achilles tendon region, just above the heel. Substantially the entire length of the patient's lower leg is supported by the downwardly concaving trough (18) while the patient's heel is suspended above the bottom of the well (16), preventing the heel from having to bear the weight of the lower leg.

18 Claims, 3 Drawing Sheets

HEEL SUPPORT APPARATUS

FIELD OF THE INVENTION

This invention relates to medical heel support devices for protecting the foot of a bedridden patient, and particularly is useful for avoiding sores and decubitus ulcer formation.

BACKGROUND OF THE INVENTION

There are a increasing number of elderly persons and hospital patients who are bedridden or spend a substantial period of their time in bed. Bedridden, elderly, and debilitated persons commonly develop decubitus ulcers or other bed sores, including in the heel region of the foot, where it is very common for the tissue to break down. This type of sore can become very painful, as well as dangerous. Additionally, when a foot is constantly covered with bed linens, the toes of the foot can become extremely sensitive to the weight of the bed linens. Further, a foot that is not vertically supported at the sole, can experience foot drop, nerve atrophy and other associated complications.

In combating the primary concern of decubitus ulcer formation at the heel, it is desirable that the patient's foot be held in a position that prevents pressure on the heel, which normally results from the heel resting against the bed surface for protracted bedridden periods of time. There have been attempts in the prior art to remedy this situation. One presently available heel support device involves the use of a heel cup which is positioned between the bed surface and the patient's heel. However, the heel cup is unsatisfactory, because such a support does not adequately distribute the weight imparted to the foot over a sufficiently large enough area. Instead, such a support merely channels the weight to a relatively small area at the Achilles region of a patient's ankle, which rests upon the periphery of the heel cup.

Various boot-type devices are another kind of apparatus disclosed in the prior art designed to support the heel. These boot supports are generally constructed of lightweight foam material and have either a split-front open design, or a wrap around and strap fasten design. The boots employ some type of cushioned heel cord lift to disperse the weight of the leg. However, these boot supports have several disadvantages. Since the leg is enclosed by the device, there is decreased air circulation around the leg, increased moisture build up within the boot, and an impaired ability to properly visually inspect the leg for medical complications.

A further attempted solution found in the prior art is the therapeutic leg support disclosed in U.S. Pat. No. 5,584,303 by Walle. The Walle support has a generally horizontal portion, with an open-topped depression that is contoured to fit the shape of a patient's leg. This horizontal portion is longitudinally rectangular in shape, with a longitudinally uniform cavity opening leading downwardly into the depression. The contoured depression is inclined and ranges from approximately one half to four-fifth of the depth of the horizontal portion, with the depression depth decreasing towards the distal end of the support. Thus, although open-topped, the side walls of the horizontal portion extend above the top the bedridden patient's leg, substantially enclosing the leg. Further advancing this enclosing effect, the side walls of the horizontal portion contour inward towards each other near the top of the upper sidewalls, creating a horse shoe shaped cavity when viewed longitudinally. This support also includes a vertical foot portion that is connected perpendicularly to the horizontal portion and fully encloses the foot.

The Walle support however, is undesirable in that, since the side walls of the leg support substantially enclose the patient's leg and in fact actually "grab" the leg, a substantial immobilization of the lower leg results. Additional contact and possible pressure or friction points are created by the Walle support, which is contrary to the present invention's goal of minimizing these types of contact. Further, since the Walle support has a vertical foot portion that is fully enclosed, air circulation is reduced and the ability to visually inspect the foot region is greatly impaired.

It is desirable to have a support apparatus that minimizes the possibility of heel or Achilles tendon decubitus ulcer formation in a bedridden patient, while also facilitating accessibility to the foot and leg for inspections and dressing changes. It is further advantageous to simultaneously ensure proper air ventilation so as to minimize the possibility of gangrene or other peripheral vascular diseases forming. The present invention provides an improved medical heel support apparatus that addresses these unresolved problems seen in the known devices in the prior art.

SUMMARY OF THE INVENTION

The present invention discloses a medical heel support apparatus that facilitates the support of the lower leg of a bedridden patient, thus relieving the pressure in the heel region of the foot. The heel support apparatus contains a substantially flat base portion for resting on top of a bed surface. The top region of the apparatus inclines in the upwardly direction moving towards the distal end of the support (away from the patient). The support is further constructed with a central, downwardly extending well area for reception of the patient's heel. Additionally, the support includes a downwardly concaving trough which extends from the proximal end of the support (under patient's upper calf) to the edge of the well area (under patient's Achilles tendon) for cradling the back of a patient's leg.

In a preferred embodiment of the present invention, the aforementioned downwardly concaving trough widens in the proximal direction (towards the patient's upper calf) to accommodate the shape of the patient's lower leg. This trough extends substantially along the entire length of the patient's lower leg, from the upper calf to the ankle, leaving the heel suspended over the well area. The support is preferably constructed of material that will mold to the shape of the patient's lower leg from the pressure placed on the support by the weight of the lower leg itself. Thus, the weight of the lower leg is distributed across as large of an area as possible, not focused at the heel. Additionally, the outside of the apparatus is covered with a breathable fabric material.

In an alternate embodiment, the central, downwardly extending well area may be constructed of a soft gel-type material. In this embodiment of the present invention, the heel would not be completely suspended, but rather would make nominal contact with the support apparatus. This would allow the patient's heel to remain in actual contact with the support apparatus, rather than being physically suspended, but yet would widely disperse any residual weight imparted from the lower leg.

In an additional alternate embodiment of the present invention, the distal region of the apparatus (away from the patient) contains an abutment wall which extends upwards, forming a vertical portion of the support apparatus. This abutment wall supports the sole of the patient's foot, holding it at a ninety degree angle from the patient's leg. The support provided by the abutment wall helps to prevent the problem known as foot drop, which can occur when the feet of a bedridden patient are left unsupported for extended periods of time. In this alternate embodiment, the abutment wall extends upwards beyond the height of the patient's toes, protecting the toes from the possible pressure of bed linens, which can lead to complications over lengthy periods of time.

A support apparatus constructed in accordance with the present invention can successfully prevent the heels of a patient's feet from developing sores and/or ulcers by channeling the weight of the patient's lower legs away from his heels, and distributing the weight over the majority of the lower leg region. The support is easily portable, simply to use, and does not cause any immobilization of the leg. It allows unobstructed access to the foot, ankle, and lower leg for inspections and/or dressing changes. Further, it does not prevent a patient from being able to get out of bed without assistance. Alternate embodiments also can protect against foot drop from tendon atrophy, and tissue breakdown in the toe area from the weight and friction of bed linens.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
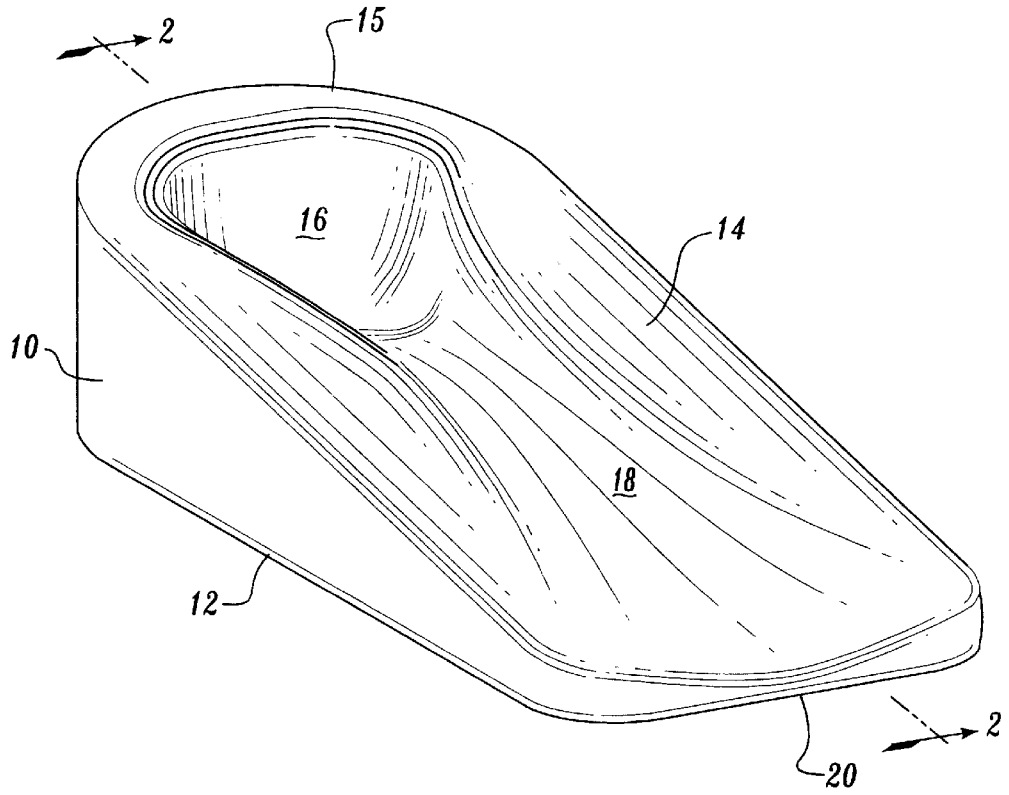
FIG. 1 illustrates an perspective view of a preferred embodiment of the present invention.

FIG. 1 illustrates a preferred embodiment of a heel support apparatus 10 constructed in accordance with the present invention and designed to support the leg of a bedridden patient so as to relieve pressure at the heel. The heel support apparatus 10 includes a substantially flat base portion 12 for resting on a bed surface. The apparatus 10 also includes an inclined top region 14 which slopes upwardly towards the distal end 15 of the support apparatus 10. The heel support apparatus 10 further includes a laterally centrally located downwardly extending well area 16 for receiving the heel of a patient's foot. Additionally, a downwardly concaving trough 18 extends from the proximal end 20 of the support 10 to the downwardly extending well 16 for receiving the back of the patient's lower leg up to the Achilles tendon region, just above the heel.

Ideally, the heel support apparatus 10 is of a length sufficient to support the entire lower leg of a patient. The outer edge of the heel support apparatus 10 is shaped as a modified oval in configuration, when viewed from above. Each individual support apparatus 10 is designed to support a single leg of a patient. The heel support apparatus 10 is constructed of a deformable material such as foamed natural or synthetic rubber, pliable silicone rubber or other suitable material, which allows the support to substantially mold to the shape of a patient's lower leg under the weight of the lower leg itself. In this preferred embodiment of the heel support apparatus 10, the outer surface of the support is covered with a breathable fabric material 24, such as Gortex®.

Figure 2:
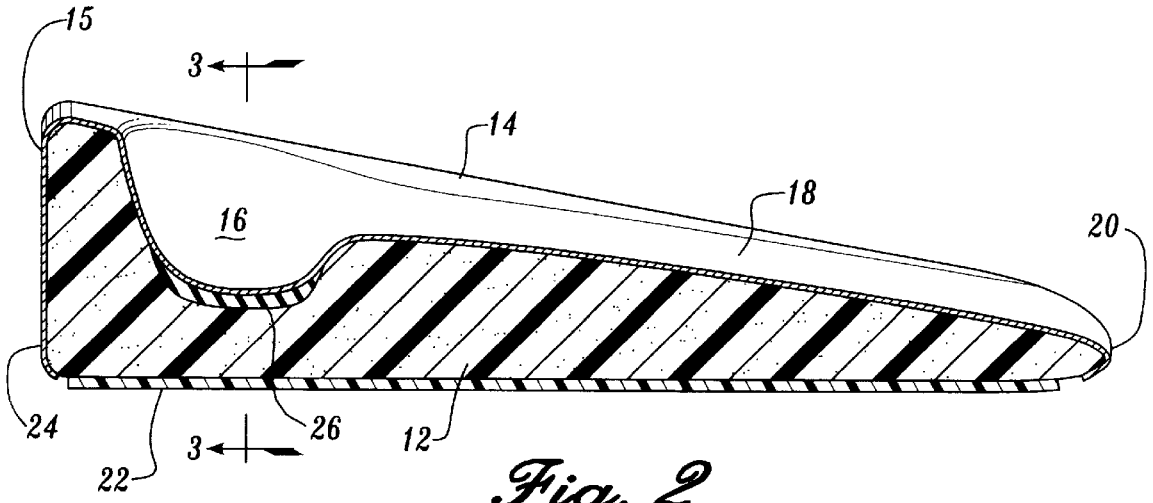
FIG. 2 illustrates a longitudinal sectional view taken about line 2—2 of FIG. 1.

Describing the invention in greater detail, as shown in FIG. 2 the horizontal base portion 12 of the heel support apparatus 10 is substantially flat. This in conjunction with the significant width of the horizontal base portion 12, provides adequate stability for the heel support apparatus 10 when placed on a bed surface. Further, the bottom surface of the horizontal base portion 12 maybe covered with a gripping material 22 such as natural or synthetic rubber, to help prevent the heel support apparatus 10 from skidding on the bed surface.

The top inclined region 14 of the heel support apparatus 10 slopes upwardly towards the distal end 15 of the support (away from the patient). As can be seen in FIG. 2 this makes the heel support apparatus appear generally wedge-shaped when viewed from the side. The low point of the wedge is located underneath the patient's upper calf at the proximal end 20 of the support. The high point of the wedge is located beyond the sole of the patient's foot at the distal end 15 of the support. The degree of inclination of the top sloped region 14 is mild, ideally on the order of 10 to 15 degrees.

Figure 4:
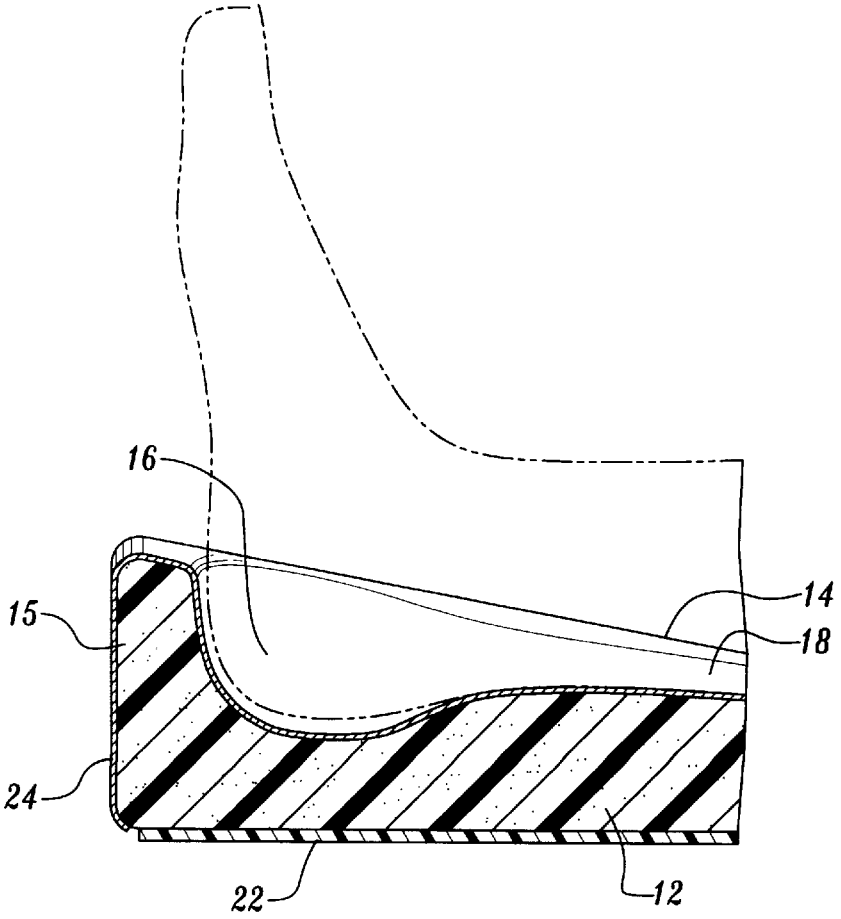
FIG. 4 illustrates; a partial longitudinal sectional view taken about line 2—2 of FIG. 1 shown supporting a patient's lower leg.

The heel support apparatus 10 contains a downwardly extending well area 16 which is located centrally widthwise across the apparatus near the distal end 15 of the support apparatus. The well 16 extends downward from the top region 14 without any pronounced edge or lip. The depth of the well area 16 extends beyond the length of the downward protrusion of a typical patient's heel. Thus, the heel of the patient is suspended over the bottom of the well 16, as shown in FIG. 4.

Alternatively, the well 16 may be partially filled with a soft gel type material 26, such as soft silicone-polymer as shown in FIG. 2. In this alternate embodiment the heel would not be completely suspended but rather would make nominal contact with the support apparatus 10. This contact however would be with the pliable gel material 26 which would widely and substantially uniformly disperse any residual weight imparted from the lower leg.

Figure 3:
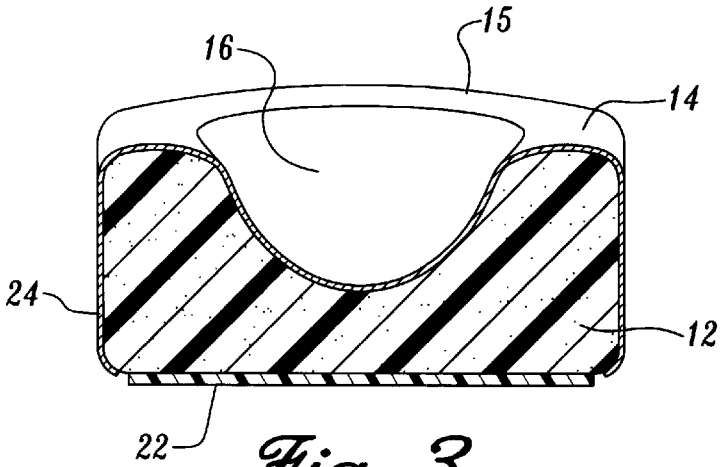
FIG. 3 illustrates a frontal sectional view taken about line 3—3 of FIG. 2.

Guiding the patient's foot to the central downwardly extending well area 16, is a downwardly concaving trough 18. Ideally the trough 18 spans from the proximal end 20 of the support apparatus 10 all the way to the well area 16. As shown in FIG. 3, the top region 14 of the apparatus slopes gently downward into the concaving trough 18 without any edge or lip. The downwardly concaving trough 18 receives the back of the patient's lower leg, providing support from the upper calf to just above the heel (the Achilles tendon region). When viewed from the front, the transition of the top region 14, as it slopes down into the trough 18 on both sides resembles a saddle, with the walls of the trough 18 flaring outwardly as they rise.

The depth of the downwardly concaving trough 18 varies in the longitudinal direction, increasing as is moves from the proximal end 20 towards the distal end 15, until it reaches the well area 16. The depth of the trough 18 however, only varies from roughly 1 to 2 inches. Thus, the trough 18 only cups the underside of a patient's leg with the majority of leg remaining above the support's upper surface 14, as shown in FIG. 4.

As can be seen in FIG. 1, the width of the trough 18 also flares outward as it moves in the proximal direction, thereby accommodating the shape of the patient's lower leg. The trough 18 supports the patient's leg along a substantial length of the lower leg rather than at a concentrated location at the back of the heel, which could also lead to ulcer formation. The downwardly concaving trough 18 is constructed of a material that deforms to accommodate the shape of the patient's lower leg region, from the pressure placed on the support by the lower leg itself. This moldability characteristic further assists the support's ability to substantially evenly distribute the weight of a patient's leg along the length of the lower leg.

Figure 5:
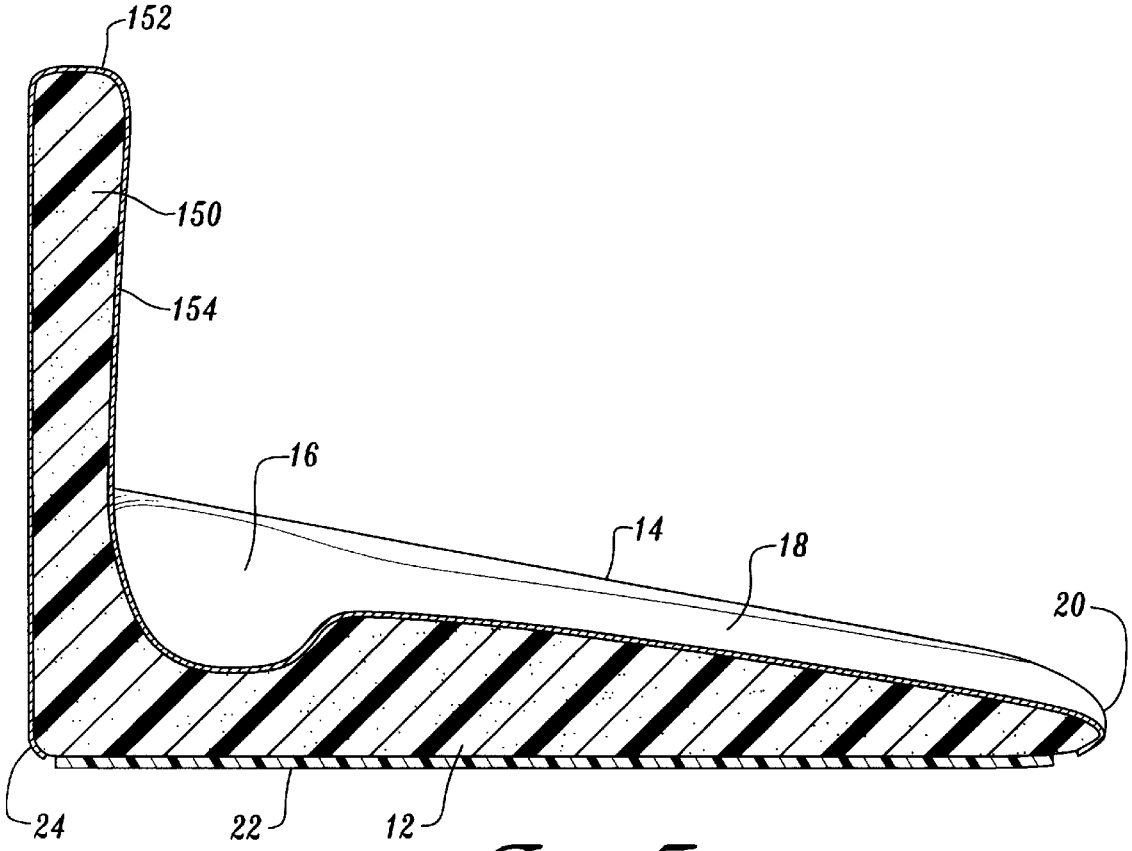
FIG. 5 illustrates a longitudinal sectional view of an alternate embodiment of the present invention which includes a vertical abutment wall at the distal end of the apparatus for supporting the sole of a patient's foot.

In an alternate embodiment, as shown in phantom in FIG. 5, the heel support apparatus 10 contains a vertically extended abutment wall 150 at the distal end 15. In this alternate embodiment, the abutment wall 150 extends vertically above the top of the patient's foot to approximately 12 to 15 inches in height. As shown in FIG. 5, the abutment wall 150 is slightly less thick than the horizontal portion of the support apparatus 10, being on the order of 1 to 2 inches in thickness. Preferably, the width of the abutment wall 150 is equal to the width of the distal end 15 of the support apparatus 10, but the width need only be roughly equivalent to the well diameter. The vertically extended abutment wall 150 rises ideally at an angle generally perpendicular to the support apparatus 10. Additionally, the abutment wall 150 is also covered with the same breathable fabric material as the rest of the apparatus. The remainder of the support apparatus structure is unchanged in this alternate embodiment.

The vertically extended abutment wall 150 allows the sole of the patient's foot to be supported against the wall's adjacent front face 154. This type of right angle support of the sole of the patient's foot helps to prevent the foot from flexing downwardly, thus guarding against the development of foot drop or flaccid foot condition which might otherwise develop as the patient's heel cord begins to shorten under bedridden conditions. These are ailments that can require substantial therapy and rehabilitation to correct and which may be prevented by this alternate embodiment of the present invention.

By having the abutment wall 150 extend beyond the height of the patient's foot, the top of the abutment wall creates a protective rim 152. This protective rim 152 protects the toes of the patient from the pressure of bed linens when the patient is in a bedridden condition. The pressure of these linens on the sensitive tissue of a patient's toes can lead to complications over lengthy periods of time, and can be prevented by transferring this pressure to the protective upper rim 152, of the abutment wall 150.

The heel support apparatus 10 according to the present invention and constructed as described hereinabove provides a number of advantageous features. When the patient is lying in a supine position the weight of the patient's lower leg will be supported by substantially the entire length of the patient's lower leg as opposed to only at the heel (or only at the Achilles tendon region, at the back of the patient's ankle). In this position, the patient's heel will be supported in a somewhat elevated position such that no pressure is exerted there against.

By eliminating or at least reducing the pressure against the patient's heel, the likelihood of significant discomfort and peripheral vascular diseases, such as decubitus ulcers, are significantly reduced. Further, the open and unenclosed construction of the apparatus of the present invention serves to enhance air ventilation to the patient's foot wherein moisture problems are otherwise likely to develop, and thus reducing the possibility of ancillary complications and disease, such as gangrene. Readily accessible visual inspection and access to the foot area are also enhanced by this unenclosed construction.

The present invention has been described in relation to a preferred embodiment and several alternate embodiments. One of ordinary skill after reading the foregoing specifications, may be able to effect various other changes, alterations, and substitutions or equivalents without departing from the broad concepts disclosed. It is therefore intended that the scope of the letters patent granted hereon be limited only by the definitions contained in the appended claims and the equivalents thereof.

The embodiments of the invention in which an exclusive property or privilege is claimed are defined as follows:

1. A heel support apparatus having a proximal end and a distal end, the apparatus comprising:

a base portion;

an inclined top portion which slopes upwardly from the proximal end towards the distal end of the apparatus;

a well area centrally located on the distal end of the inclined top portion of the apparatus and extending downwardly therefrom, the well area having an approximately arcuate cup-like shape, being configured to substantially correspond to the shape of a patient's heel; and a single, substantially arcuate, downwardly concave shallow trough having a bottom, configured to receive only a single lower leg of a patient, and extending from the proximal end of the support apparatus to intersect the well area, said trough configured to substantially correspond in shape to the back of a patient's leg, said trough continuously increasing in depth in the distal direction from the proximal end of the trough towards the well area, and said trough having sidewalls flaring outward in the direction laterally of the length of the trough from the bottom center of the trough configured to only cup the bottom portion of a supine patient's leg.

2. An apparatus according to claim 1, wherein said trough widens in the direction away from the well area and towards the proximal end of the apparatus, thereby corresponding to the shape of a patient's lower leg.

3. An apparatus according to claim 1, wherein said downwardly concaving trough is of sufficient length to support a substantial length of a patient's lower leg region, from the ankle to at least the calf.

4. An apparatus according to claim 1, wherein said trough is composed of a sufficiently pliable material that is configured to substantially mold to the shape of a patient's lower leg region from the pressure placed on the support apparatus by the patient's lower leg region.

5. An apparatus according to claim 1, wherein the well area is sized and configured to extend downward further than the penetration depth of an average adult patient's heel, whereby the average adult patient's heel is suspended above the bottom of the well area.

6. An apparatus according to claim 1, wherein the distal end of the inclined top portion of the apparatus is further extended vertically upwards, generally orthogonally from the base portion, to form an abutment wall, whereby the sole of a patient's foot can be supported.

7. An apparatus according to claim 6, wherein the abutment wall of the apparatus is configured to reach a height beyond that of a patient's toes, thereby protecting the toes from the possible pressure of bed linens.

8. An apparatus according to claim 1, wherein the well area is configured to extend downward to a depth that allows a patient's heel to make nominal contact with the bottom of the well area, but still causes the majority of the weight of the lower leg to be supported by the downwardly concaving trough.

9. An apparatus according to claim 1, wherein the apparatus is covered with a breathable fabric material.

10. A heel support apparatus having a proximal end and a distal end, the apparatus comprising:

a base portion;

an inclined top portion which slopes upwardly from the proximal end towards the distal end of the apparatus;

a well area centrally located on the distal end of the inclined top portion of the apparatus and extending downwardly therefrom, the well area having an approximately arcuate cup-like shape, being configured to substantially correspond to the shape of a patient's heel; and a single downwardly concave shallow trough having a bottom, configured to receive a single lower leg of a patient, and extending from the proximal end of the support apparatus to intersect the well area, said trough configured to substantially correspond in shape to the back of a patient's leg, said trough increasing in depth in the distal direction towards the well area, and said trough having sidewalls flaring outward in the direction laterally of the length of the trough from the bottom center of the trough configured to only cup the bottom portion of a supine patient's leg; wherein the well area is configured to extend downward to a depth that allows a patient's heel to make nominal contact with the bottom of the well area, but still causes the majority of the weight of the lower leg to be supported by the downwardly concaving trough; and wherein the well area is composed of a soft gel material that is more pliable than the material comprising the rest of the support apparatus, thereby allowing the weight transferred by the nominal contact in the heel region to be widely dispersed about the well area.

11. An apparatus according to claim 10, wherein the distal end of the inclined top portion of the apparatus is further extended vertically upwards, generally orthogonally from the base portion, whereby the sole of a patient's foot can be supported.

12. An apparatus according to claim 11, wherein the abutment wall of the apparatus is configured to reach a height beyond that of a patient's toes, thereby protecting the toes from the possible pressure of bed linens.

13. A heel support apparatus, comprising a longitudinal heel support section for supporting the lower leg of a supine patient, the support section having a calf end portion at approximately the calf area of the patient's leg and having a heel end section at the heel area of the patient's leg, said support section further comprising:

a top inclined surface sloping upwardly in the direction from the calf end portion to the heel end portion of the support section;

a single opening in the top surface of the support section adjacent the heel end portion of the support section, the opening being of sufficient depth and breadth to contour below the patient's heel to prevent the heel from contacting the bottom of the opening, said opening being configured to substantially correspond in shape to a patient's heel; and a single, substantially arcuate, shallow channel formed longitudinally in the top surface configured to support and receive only a single lower leg, the channel having a bottom center and extending from the opening in the top surface to the calf end portion of the support section, said channel flaring outwardly in the direction laterally of the length of the channel from the bottom center of the channel configured to substantially correspond in shape to the back of the patient's leg and only cup the bottom portion of the patient's leg, said channel increasing in width in the direction from the opening in the top surface toward the calf end portion of the support section to approximate the shape of the patient's lower leg; and wherein the channel continually increases in depth from the calfend portion to the opening formed in the top surface of the support section.

14. An apparatus according to claim 13, wherein said contoured open-topped portion is adapted of a sufficiently pliable material that is configured to further mold to the shape of a patient's lower leg region from the pressure placed on the support apparatus by the lower leg region.

15. An apparatus according to claim 13, wherein the apparatus is covered with a breathable fabric material.

16. The apparatus according to claim 13, further comprising an abutment wall extending upwardly from the heel end portion of the support section to an elevation substantially above the top surface of the support section.

17. An apparatus according to claim 16, wherein the abutment wall is configured to extend upwardly to a height above that of a patient's toes.

18. A heel support apparatus, comprising a longitudinal heel support section for supporting the lower leg of a supine patient, the support section having a calf end portion at approximately the calf area of the patient's leg and having a heel end section at the heel area of the patient's leg, said support section further comprising:

a top inclined surface sloping upwardly in the direction from the calf end portion to the heel end portion of the support section;

an single opening in the top surface of the support section adjacent the heel end portion of the support section, the opening being of sufficient depth and breadth to contour below the patient's heel to prevent the heel from contacting the bottom of the opening, said opening being configured to substantially correspond in shape to a patient's heel; and a single shallow channel formed longitudinally in the top surface configured to support and receive a single lower leg, the channel having a bottom center and extending from the opening in the top surface to the calf end portion of the support section, said channel flaring outwardly in the direction laterally of the length of the channel from the bottom center of the channel configured to substantially correspond in shape to the back of the patient's leg and only cup the bottom portion of the patient's leg, said channel increasing in width in the direction from the opening in the top surface toward the calf end portion of the support section to approximate the shape of the patient's lower leg, wherein the channel increases in depth in the direction from the calf end portion towards the opening formed in the top surface of the support section and, wherein the depth, of the channel ranges from approximately one inch at the calf end portion of support section to approximately two inches at the intersection of the channel and the heel receiving opening formed in the top surface of the support section.

* * * * *

UNITED STATES PATENT AND TRADEMARK OFFICE

CERTIFICATE OF CORRECTION

PATENT NO. : 5,997,491
DATED : December 7, 1999
INVENTOR(S) : A.L. Harris

It is certified that error appears in the above-identified patent and that said Letters Patent is hereby corrected as shown below:

Title page,
Item [56], References Cited, U.S. PATENT DOCUMENTS insert in appropriate numerical order the following:

| | | |
|---|---|---|
| -- 2,478,497 | 6/1946 | Morrison |
| 2,640,205 | 6/1953 | Simpson |
| 2,669,989 | 2/1954 | Shoucair |
| 3,803,645 | 4/1974 | Oliverius |
| 4,266,298 | 5/1996 | Graziano |
| 4,478,214 | 10/1984 | Lamont |
| 5,497,789 | 3/1996 | Zook |
| 5,584,303 | 12/1996 | Walle -- |

Column 7,
Line 57, delete "of the support section"

Column 8,
Line 60, "section and, wherein" should read -- section, and wherein --
Line 60, after "depth" delete ","

Signed and Sealed this

Fifteenth Day of January, 2002

*Attest:*

*Attesting Officer*

JAMES E. ROGAN
*Director of the United States Patent and Trademark Office*